United States Patent [19]

Paulsson

[11] Patent Number: 4,910,926

[45] Date of Patent: Mar. 27, 1990

[54] ARRANGEMENT IN EAVE GUTTERS

[75] Inventor: Arne Paulsson, Järnforsen, Sweden

[73] Assignee: AB Siba - Verken, Sweden

[21] Appl. No.: 275,059

[22] PCT Filed: May 13, 1987

[86] PCT No.: PCT/SE87/00237

§ 371 Date: Nov. 15, 1988

§ 102(e) Date: Nov. 15, 1988

[87] PCT Pub. No.: WO87/06969

PCT Pub. Date: Nov. 19, 1987

[30] Foreign Application Priority Data

May 15, 1986 [SE] Sweden ..... 8602205

[51] Int. Cl.[4] ..... E04D 13/00

[52] U.S. Cl. ..... 52/11; 52/13

[58] Field of Search ..... 52/11, 13, 15, 58

[56] References Cited

U.S. PATENT DOCUMENTS

| | | | |
|---|---|---|---|
| 2,784,687 | 3/1957 | Hovey | 52/11 |
| 3,295,803 | 1/1967 | Blayden | 52/11 X |
| 3,296,749 | 1/1967 | Cotter | 52/11 |
| 4,241,548 | 12/1980 | Rowe | 52/11 |

*Primary Examiner*—David A. Scherbel
*Assistant Examiner*—Creighton Smith
*Attorney, Agent, or Firm*—Davis, Bujold & Streck

[57] ABSTRACT

An eaves gutter arrangement includes a channel section (1), the bottom surface (12) of which is supported by a gutter mounting bracket (2) attached to an eaves board with the rear wall (10) of the channel section in abutment with the bracket. The bracket includes a tongue (56) which engages around the upper edge (16) of the rear wall of the channel section. The free long edge of the front wall (14) of the channel section has a claw-like configuration, such as to form an anchorage (22) for one end (72) of a strut (3). The mounting bracket (2) has an upper part (46) in which there is formed a part (58) which protrudes outwardly towards the channel section (1), in a manner to define a pocket (60) into which a downwardly extending part of the other end (79) of the strut can be inserted and secured. The tongue (56) comprises a part punched from the mounting bracket (2) at a location beneath the outwardly protruding part (58). The tongue is a lower continuation of the outwardly protruding part and preferably incorporates a spring-like characteristic.

13 Claims, 3 Drawing Sheets

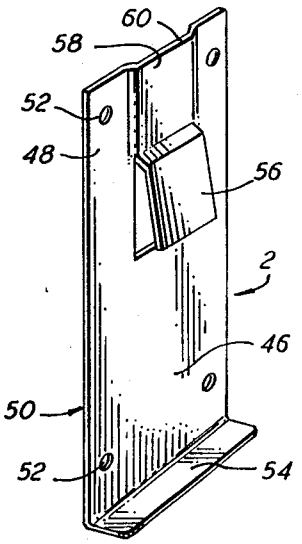
FIG. 3
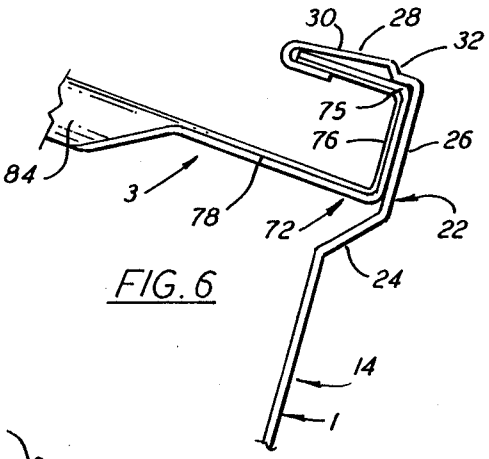
FIG. 6
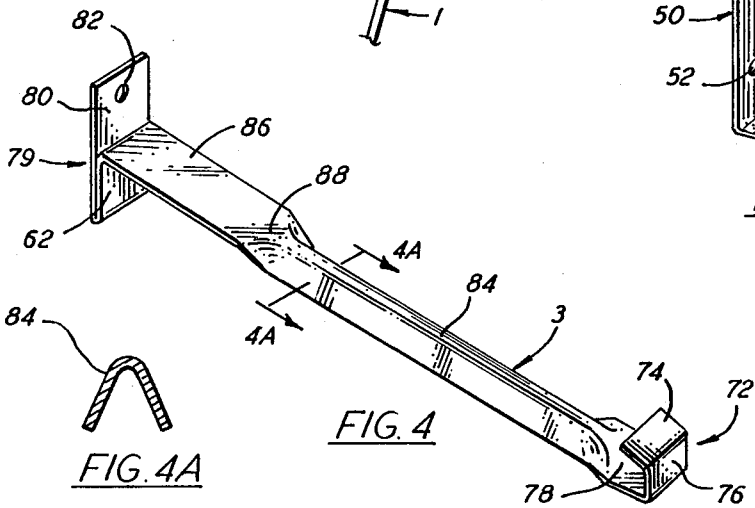
FIG. 4
FIG. 4A
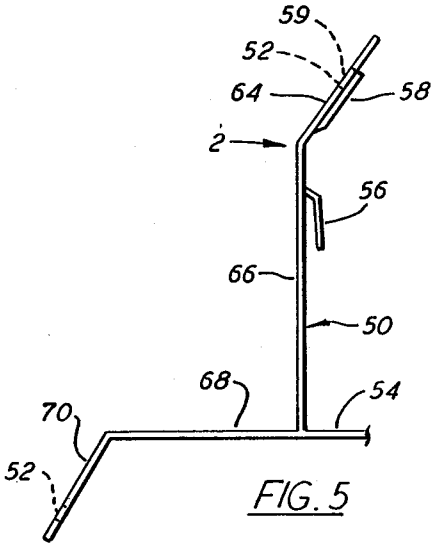
FIG. 5
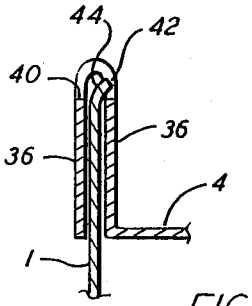
FIG. 7

ARRANGEMENT IN EAVE GUTTERS

The present invention relates to an arrangement in eave gutters of the kind set forth in the preamble of claim 1.

Many different kinds of channel sections for eave gutters, and associated mounting devices are known to the art. One serious disadvantage with these known channel sections is that they often need to be manufactured to accurate measurements. Another drawback with known gutter arrangements of this kind is that they fail to provide a facility whereby the channel section can be permitted to twist or skew prior to being fitted. This requires subsequent alignment of the channel sections, which is both troublesome and time consuming.

US-A 3 150 851 teaches a gutter arrangement comprising a channel section and channel mounting devices comprising a mounting bracket and a strut or brace of the kind set forth in the preamble of the main claim, one end of this brace or strut engaging in the mounting bracket and the other end engaging the front edge of the channel section. In this prior art arrangement) the strut engages a groove provided in the lower edge of the rear wall of the channel section through a bridging tongue and extends therefrom essentially horizontally to the front edge of the channel section. The groove and the co-acting, downwardly extending part of the strut present saw-tooth locking surfaces.

This earlier known construction is encumbered with several drawbacks. The mounting bracket is manufactured from extruded aluminium and presents a tongue which extends obliquely downwards from a shoulder or abutment surface adjacent the upper edge of the vertical part. When fitting a gutter to the eaves, the tongue is forced in against the rear wall of the channel section and is expected to be held firmly thereby. Any load exerted on the gutter, subsequent to fitting the strut will attempt to withdraw the tongue. The tongue is thus constantly subjected to fatigue stresses, and since aluminium has a low fatigue strength, it is liable to fracture after being in use for but a short time. The horizontal extension of the strut also means that the strut is not able to absorb vertical loads on the gutter or channel section. Furthermore, the saw-tooth abutment surfaces make it impossible to remove the strut from the mounting bracket without seriously damaging or destroying the serrated locking surfaces. Moreover, because the strut is lowered within the channel section, the strut is liable to form a trap for any leaves falling therein, and inhibits the flow of water along the guttering.

The publication AU-B 35801/78 teaches an eaves gutter which, distinct from the aforementioned gutter arrangement, includes a strut or brace having an upwardly bent part which can be inserted beneath the tongue and which is intended to press the rear wall of the channel section firmly against the mounting bracket. The upwardly bent part of the strut and the tongue are locked firmly together by means of co-acting grooves and outwardly projecting parts. The opposite end of the strut is of part-circular configuration and is held in a corresponding part-circular upper edge on the front wall of the channel section.

This gutter arrangement is even less able to take-up vertically acting loads, since the strut of this arrangement extends obliquely upwards. The obliquely downwardly extending struts also form traps which collect any leaves falling into the gutter, therewith forming dams which prevent the water from running into the downpipe. Consequently, such gutters have to be cleansed regularly. The struts can also be dislodged out of engagement with the tongue.

The object of the present invention is therefore to provide an arrangement in eaves gutters comprising a channel section and gutter mounting devices of the aforesaid kind which are capable of being mounted simply and rapidly, even though the channel sections have been deformed, and which will be positively and stably attached subsequent to being mounted, and in which the channel sections, when necessary, can be readily and quickly dismantled without damage thereto. A further object is to enable such gutters to be produced at low cost and to provide a general step forwards in this art. Another object of the present invention is to provide a strut or brace which is capable of taking-up vertical loads acting on the front edge of the gutter, and which will not constitute a leaf-trap or present an obstacle to the flow of water and which can be positively attached separately in the fitting and is able to withstand high, momentarily acting transverse loads without loosening from its fitting or breaking.

These objects are achieved with a gutter arrangement of the aforesaid kind formed in accordance with the characterizing clause of the following claim 1.

In this way there is obtained a force-fitted attachment means which is separate from the tongue, such that the strut is located above the respective channel section, and therewith presents no obstacle to the flow of water therethrough, and obtains an upwardly directed tension force component capable of taking-up vertical loads. Because the mounting bracket according to claim 2 has a part which extends up over the top edge of the rear wall and which defines a pocket intended to accommodate an angled part of the strut, there is obtained separate attachment points for the rear edge and front edge of the channel section, at the same time as the strut is also able to take-up vertical loads acting on the front edge of the channel section and permits water to flow freely through said section in the absence of damming leaf agglomerations.

The further feature of the strut according to FIG. 4, enabling the strut to be firmly anchored to an adjacent part of the building ensures that the channel section is firmly and securely fitted. Because the strut is anchored in said building part, the strut will exert a retaining and supporting force on the channel section even if the mounting bracket becomes damaged or the channel section is dislodged from its position on the bracket. This arrangement also relieves the load on the upper attachment pints of the gutter mounting bracket.

The invention will now be described in more detail with reference to a non-limiting embodiment thereof and also with reference to the accompanying drawings, in which FIG. 1 is a perspective view of an eaves gutter which is mounted with the aid of bracket devices, of which only one is shown;

FIG. 3 is a perspective view of a gutter mounting bracket;

FIG. 4 illustrates a strut or brace for the gutter arrangement illustrated in FIG. 1;

FIG. 5 illustrates an alternative bracket mounting;

FIG. 6 illustrates a claw-like strut part in engagement with the channel section;

FIG. 7 illustrates the attachment of an end cover-member;

Figure 1:
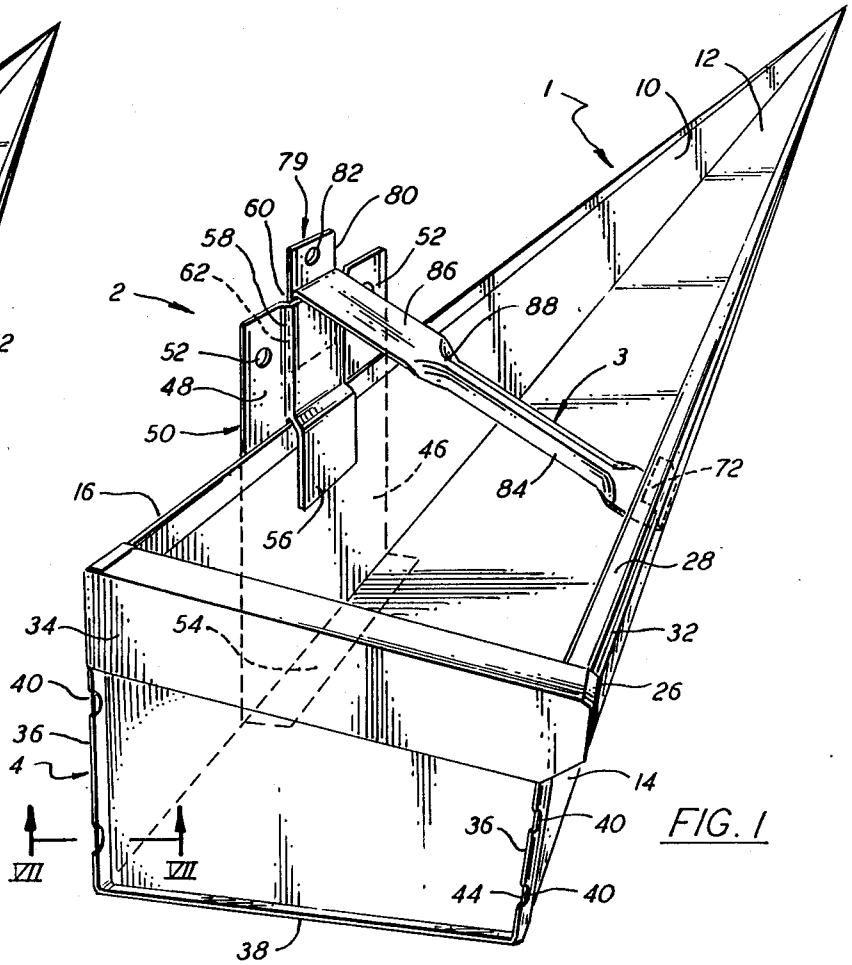
Figure 2:
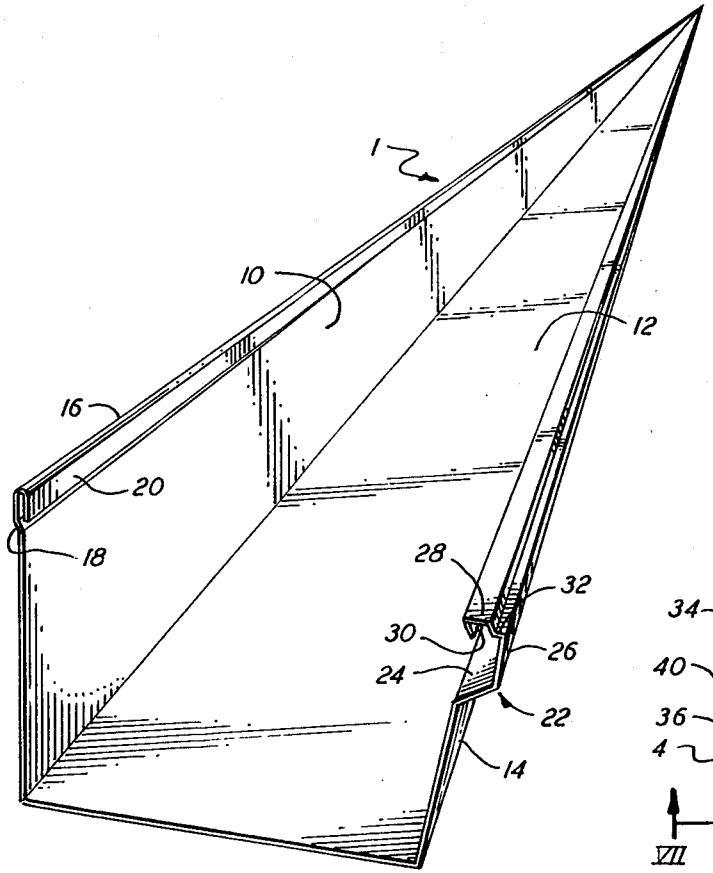
FIG. 2 is a perspective view of a channel section forming part of the gutter arrangement illustrated in FIG. 1.

The drawings illustrate guttering comprising a channel profile or section 1 having a rear wall 10, a bottom surface 12, and a front wall 14. The upper edge 16 of the rear wall is folded to double thickness, and preferably is formed with a Z-shaped fold 18 and an inwardly extending skirt 20 which lies parallel with the plane of the inner surface of the rear wall 10. This provides a rigid structure which presents no sharp cutting edge and which avoids the gathering of dirt in the fold.

The bottom surface 12 of the channel section is essentially flat and extends preferably horizontally. The front wall 14 of the illustrated embodiment is inclined slightly outwards. It may, however, be gently swung or curved and need not exhibit solely straight surfaces separated by sharp corners.

The free, long edge of the front wall 14 has a claw-like part in the form of an outwardly bulged portion 22 which, in cross-section, has generally a shape of a U or a frustrated V. The outward bulge 22 has a lower limb 24 which merges with the main part of the front wall 14, a web 26 and an upper limb 28 in the form of a flange or lip which extends towards the upper edge 16 of the rear wall. The web 26 is substantially parallel with the main surface of the front wall 14. The forwardly located end part of the flange 28 is formed in a manner to present a groove or channel 30, the mouth of which faces towards the upper part of the front wall 14, i.e. faces towards the web 26 of the bulged portion 26. An angled part, or corner part 32 is located at the junction between the web 26 and the flange 28, the purpose of which corner part will be explained herebelow.

FIGS. 1 and 7 illustrate an end cover-member 4 which is intended to be fitted to the channel section 1. The upper edge of the end cover-member 4 is folded over to form a substantially U-shaped stiffening or reinforcement 34. The reinforcement 34 is located on the same level as the bulged portion 22 and has roughly the same form thereas, with the exception that the end cover-member has no groove 30 and no inwardly projecting corner part 32, since these two features play no part in the function of the end cover-member of the gutter arrangement.

To facilitate fitting of the end cover-member onto the gutter, the side edges and bottom edge of said member are folded in a manner to form channel-like attachment flanges 36 and 38, which have two holes 40 provided in the bottom thereof.

When fitting a cover-member to a channel section, a jointing compound or some corresponding substance is placed in the attachment channels 36 and 38, whereafter the cover-member and channel section are brought together, so that the end edges 42 of the channel section project through the holes 40 in the cover-member. Preferably, no holes are formed in the bottom channel or flange 38, in order to avoid the possibility of a leakage. There is obtained in this way, inexpensively and through simple means, a highly stable and water-tight fitting between the end-covers of the gutter and the channel section thereof.

The gutter mounting racket, shown generally at 2, comprises a substantially vertical part 46 which is intended to lie against the rear wall 10 of the channel section. The vertical part 46 has an upper part 48 and a lower part 50, and is referred to hereinafter as the base plate. The base plate 50 has provided therein holes 52 through which nails, screws or like fasteners can be inserted, for securing the bracket to an eaves board or soffit. Located at the bottom of the base plate 50 is an outwardly projecting, substantially horizontal support shelf 54, which supports against the bottom surface 12 of the channel section. A tongue 56 extends from the upper part 48 of the vertical bracket part 46, parallel with or at a slight acute angle to the vertical part 46. The tongue 56 is formed by punching a flap from the base plate 50 and bending the flap in opposite directions. The distance between the base plate and the tongue 56 is essentially equal to the thickness of the folded edge 16 of the channel section 1, with a given degree of clearance. The upper part 48 of the vertical plate 46 has arranged thereon, above the tongue 56, an outwardly projecting part 58, which extends from above the junction at which the tongue 56 meets the base plate 50 optionally to the upper edge of the upper part 46 of said base plate. This outwardly projecting part 58 defines, together with an opposing surface of the eaves board, a pocket 60 into which an angled part 62 of a strut 3 is inserted, as described in more detail hereinafter. The outwardly projecting part 58 may advantageously extend from the edge of said upper bracket part 46 to said junction between a tongue 56 and the base plate 50. This results in decreasing the extent to which the tongue can be sprung and also reduces the lever forces acting on the junction point of the tongue, while at the same time the lower part of the projection 56 will form a stop abutment for the upper edge 16 of the rear channel wall.

As before indicated, the slightly outwardly projecting part 56 of the base plate 50 need not necessarily extend right to the outward edge of the base plate, but may terminate at a distance from said edge. To this end, one or two horizontal grooves 59 may be formed in the base plate and the underlying part, or intermediate part, of the base plate may be caused to project outwards, as shown at 58 in FIG. 5.

The eaves board is often not truly vertical, but inclined (perpendicular to the slope of the roof). In cases such as these, there is provided in accordance with FIG. 5 a gutter mounting bracket 2 which has a curved base plate 50 having integral therewith an oblique upper part 64, a vertical part 66, a horizontal intermediate part 68, and a lower oblique part 70. The oblique parts 64,70 have formed therein screw-holes or nail-holes 52, for attachment of the bracket to an eaves board. The vertical part carries the support shelf 54 and the tongue 56. The outwardly projecting part 58 forming the aforesaid pocket together with the eaves board is preferably located on the upper oblique part of the bracket, but may also be located on the vertical part thereof. The bracket is divided beneath the vertical part 66 into a plurality of tongues which form the support shelf 54, or a multiple of such shelves, and also the intermediate part 68 and the lower oblique part 70. In order to achieve a loading symmetry when mounting the end section, it is preferred to use one or more symmetrically located support shelves. The tongue 56 and the outwardly projecting part 58 are positioned symmetrically with the supporting shelf or shelves 54.

The channel section 1 or gutter is secured to a respective mounting bracket 2 with the aid of a strut 3, illustrated in FIG. 4. The strut 3 has located at one end thereof a hooked or claw-part 72 which includes a free end-part or tip 74, and a web part 76, said tip 74 extending substantially in the direction of the longitudinal axis of the strut. The tip portion 74, the web 76 and that part 78 of the strut adjacent the web 76 are slightly curved in the direction of the long axis into a V-shape or are undulated to provide the desired rigidity. The other end of the strut 3 carries an attachment plate having a downwardly angled part 62. According to one preferred embodiment, the part 62 is folded to double thickness, the free end of said part projecting out in the manner of a tab 80, beyond the straight part of the strut. The tab 80 has provided therein a hole 82 for receiving, e.g., a fastener, such as a nail or a screw for securing the strut in position. That part 84 of the strut located nearest the claw-shaped end 72 has, in cross-section, the shape of an inverted V. This affords a high flexural strength while preventing the accumulation of water and dirt.

The gutter is mounted in the following manner. The mounting brackets are attached to the eaves board at suitable locations therealong, and the channel section 1 is offered up to a respective bracket and the upper edge 60 on the rear wall 10 of the channel section is inserted in between the vertical part 46, or 64, and the tongue 56 of the base part 50, such that the bottom surface of the channel section rests on the support shelf 54. The tip portion 74 of the claw-shaped part 72 of said strut is there introduced into the groove 30, such that the web 76 will lie against the inner surface of the front wall 14, more specifically against the web 26 of the outward bulge 22. The corner or junction, referenced 75 in the Figure, between the tip portion 74 and the web 76 of said claw-shaped strut part 72 lies against the inwardly projecting corner part 32 of the outwardly bulged portion 22. The strut will now take a position in which it extends towards some point above the rear wall 10 nd the pocket 60 defined by the base plate 50 and the eaves board, as described above. The strut is then secured firmly in position, by forcing the downwardly extending insert part 62 of the strut into the pocket 60, with the aid of a suitable tool. This position of the strut can be additionally secured, by driving a nail or screw through the hole 82 in the upper part of the attachment plate 79. When the strut 3 is mounted in position, the tip portion 74 and the cornered part 75 of the strut will act as a lever against the groove 30 and the inwardly extending corner part 32, such as to press the bottom surface 12 of the channel section against the supporting shelf 54, therewith providing a positive attachment in the absence of any clearance of play. In this regard, the inwardly projecting corner part 32 forms an important fulcrum point for the moment of force exerted by the strut on the channel section. This provides a better effect than the case when moments of force are transmitted via the inner surfaces of the flange 28 or the web 26 of the outwardly bulged part 22. At the same time, the inwardly extending corner part 32 of said outwardly bulged part affords greater rigidity to the channel section in this region thereof. Without this corner part, the flange 28 and the web 26 are liable to become deformed, therewith losing the aforesaid lever effect and resulting in a loose fitting.

It is not absolutely necessary for the channel section of the inventive guttering to have an outwardly bulging part 22 of the aforedescribed configuration. It is sufficient for this portion of the channel section to present a flange or lip 28 which extends towards the top edge of the rear wall, and a groove or channel 30 which opens towards the upper part of the front wall 14. An inwardly projecting corner part 32 is also preferably provided, in the aforedescribed manner.

The strut 3 includes between the part 84 of inverted V-cross-section and the planar part 86 a bridging part 88 which forms a bending facility, such as to enable the strut to bend resiliently at this location. For example, if the strut should prove to be too long when the angled insert part 62 of the fitting is forced, e.g. hammered, into its respective pocket 60, as is normally the case, the strut is able to bend at the location of this bend facility. This results in a bend that has spring characteristics, such as to urge the claw-shaped part 72 outwards and against the inner surface of the front wall of the channel section, therewith avoiding the occurrence of any play or clearance.

Figure 9:
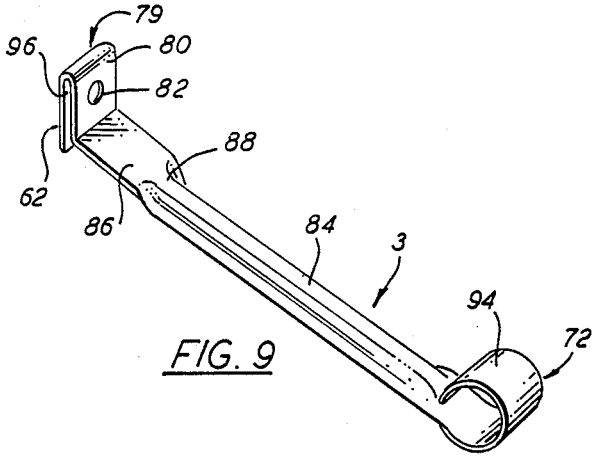
FIG. 9 illustrates an alternative mounting strut for the channel section shown in FIG. 8.
Figure 8:
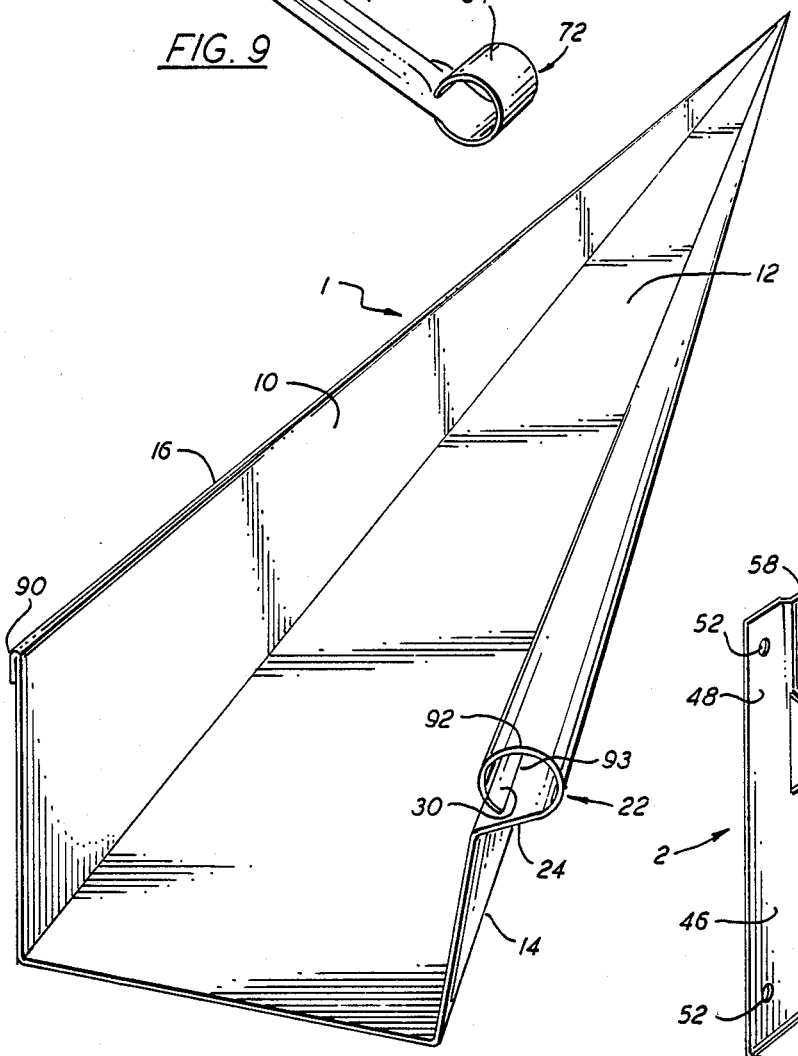
FIG. 8 is a perspective view of an alternative channel-section configuration for an eaves gutter according to the invention.
Figure 10:
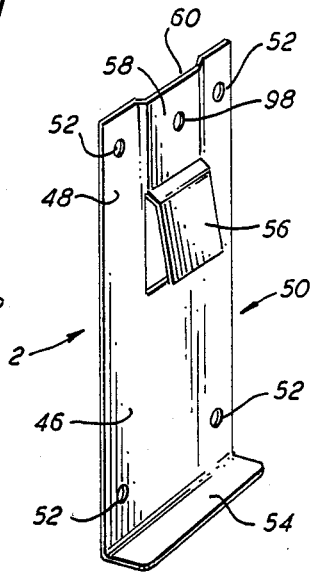
FIG. 10 is a perspective view of a mounting bracket intended for use with the strut shown in FIG. 9.

FIGS. 8–10 illustrate a further embodiment of the invention. Corresponding gutter components and features have been identified with the same reference numerals as those used in the earlier embodiments. It will be understood that various features of this embodiment can also be combined with features of the earlier described embodiments, in any desired suitable fashion. In the embodiment illustrated in FIG. 8, the upper edge of the rear wall 10 of the channel section 1 is folded in a manner to produce a fold 16 having a skirt 19 locate on the outer side of the channel wall. This provides a smooth inner surface along the rear wall 10 and also brings down manufacturing costs. In the embodiment illustrated in FIG. 8, the outwardly bulged portion 22 on the front wall 14 of the earlier channel-section embodiments is replaced with a claw-like attachment socket 22, incorporating a part-cylindrical portion 92 which merges on one side thereof with a straight junction piece 24, extending out from the wall 14, and which presents along the other side thereof a free-standing edge which terminates at a distance from the junction piece 24. The part-cylindrical attachment socket 92 defines a channel 30 which is intended to receive the claw-like end 72 of the strut 3, said end 72 of the strut in this case preferably having a corresponding part-cylindrical portion at 94, as illustrated in FIG. 9.

In accordance with an alternative embodiment, the claw-shaped end 72 of the strut 3 may be formed in a manner which will enable it to be fitted into the part-cylindrical socket 92 at selected locations therealong, by means of a twisting or screwing action. According to another alternative embodiment, the claw-shaped part 72 of the strut is constructed so that it will be held in the part-cylindrical socket 92 in a manner which ensures that the strut will not be dislodged. In this case, the claw-shaped parts 72 of respective struts must be inserted before placing the end cover-members 4 in position, or alternatively separate insertion locations, in the form of cut-outs or outwardly bent parts, must be provided in the part-cylindrical attachment socket 92.

The attachment of the strut 3 in a part-cylindrical attachment socket provides a positive but movable attachment, in the absence of inherent stresses or lever-arc effects.

The strut of the FIG. 9 embodiment has at its other end an attachment part, generally referenced 79, which comprises an upstanding portion 18 which is connected to the central part of the strut and which is folded over in a manner to form a depending skirt portion 62 in spaced, opposing relationship with the upstanding portion, therewith to form a slot 9 into which the pocket-defining wall (the outwardly projecting part 58) of the channel section is inserted. The upstanding part 80 and its opposing skirt 62 have formed therein mutually registering screw-holes or nail-holes, as indicated at 82. To enable the attachment part 79 of the strut to be secured to its respective mounting bracket 2, the bracket may be provided with a hole 98 in the outwardly projecting part 58, as shown in FIG. 10.

I claim:

1. An eave gutter arrangement comprising:

an elongate channel section having a rear wall, a bottom surface and a front wall with an elongate claw like configuration extending along a free edge of the front wall;

a mounting bracket, for attachment to an eave, having support means at a lower end thereof for supporting the bottom surface of a said channel section and tongue means adjacent an upper end thereof for engaging a free edge of the rear wall of the said channel section; and at least one strut having means at one end thereof for engaging the claw like configuration of the said channel section and an opposite end thereof for connection with said mounting bracket, adjacent the tongue means, wherein said mounting bracket further includes a projecting part which projects away from an eave, when said mounting bracket is attached to a building, whereby said projecting part and the eave define a pocket for receiving and securing the opposite end of said strut to the mounting bracket.

2. An arrangement according to claim 1, wherein the tongue means comprises a punched portion of said mounting bracket.

3. An arrangement according to claim 1, wherein the tongue means is resilient and comprises a continuation of the projecting part.

4. A arrangement according to claim 1 wherein the mounting bracket includes a base plate having a substantially vertical part for abutment with the rear wall of the said channel section and further includes an upper part extending beyond the free edge of the rear wall, the projecting part of said mounting bracket is formed in said upper part, and said strut, when its opposite end is fitted within the pocket, extends obliquely outward from the pocket toward the free edge of the front wall.

5. An arrangement according to claim 1 wherein the opposite end of said strut includes a downwardly angled part, for engaging the pocket, and a tab, extending in an opposite direction, incorporating means for securing said strut to an adjacent building part once the downwardly angled part is received within the pocket.

6. An arrangement according to claim 5, wherein a central part of the strut comprises an inverted V-shaped cross-section part and a flat section part with an intermediate junction part therebetween and the downwardly angled part at the opposite end thereof includes a double-folded over portion which projects upwardly to form the tab, whereby said strut has at least a partially non-planar, stiffening cross-section.

7. An arrangement according to claim 5, wherein the claw-like configuration of the front wall comprises an outwardly bulging part formed by an elongate lower limb extending from the front wall which merges with an elongate web which merges with an elongate corner part which merges with an elongate upper limb, a free end of which is bent to define a channel, said strut has a corresponding claw-like configuration whereby when the claw-like configurations engage one another said strut exerts a lever effect on the said channel section so as to urge the bottom surface of the said channel section against the support means.

8. An arrangement according to claim 5, wherein the claw-like configuration of the front wall includes a partial elongate cylindrical part which extends from the front wall and defines a channel therein and the strut has a corresponding partial cylindrical part for engaging the cylindrical part of the front wall.

9. An arrangement according to claims 1, wherein the upper edge of the rear wall of the said channel section is folded over to form a Z-shaped fold with an inwardly elongate extending skirt so that the surface of the skirt facing inwardly of the said channel section lies in a plane formed by the inner surface of the rear wall.

10. An arrangement according to claim 1, further including at least two end cover-members for attachment to opposed ends of the said channel section, each said end cover member including means for engaging the ends of said channel section and securing the end cover-members in position.

11. An arrangement according to claim 1 wherein the mounting bracket includes a base plate incorporating means for attaching the mounting bracket to a surface.

12. An arrangement according to claim 1 wherein the mounting bracket includes a base part incorporating a vertical part and an oblique part, provided with means for attaching said mounting bracket to a building surface, and an intermediate part which joins the vertical part to the oblique part, and the pocket being defined by the oblique part.

13. A mounting bracket, for attachment to an eave, having support means at a lower end thereof for supporting a bottom surface of a channel section, tongue means adjacent an upper end thereof for engaging a free edge of a rear wall of a channel section, and means for securing the mounting bracket to a building surface, wherein said mounting bracket further includes a projecting part, adjacent the upper end, which projects away from an eave when said mounting bracket is attached to a building, whereby said projecting part and the eave define a pocket for receiving and securing one end of a strut to the mounting bracket.

* * * * *